US007695261B2

(12) United States Patent
Patterson

(10) Patent No.: US 7,695,261 B2
(45) Date of Patent: Apr. 13, 2010

(54) FLOATING DAM POSITIVE DISPLACEMENT PUMP

(75) Inventor: Albert W. Patterson, West Lorne (CA)

(73) Assignee: 1564330 Ontario Inc., Seaforth, Ontario (CA)

( * ) Notice: Subject to any disclaimer, the term of this patent is extended or adjusted under 35 U.S.C. 154(b) by 319 days.

(21) Appl. No.: 11/798,362

(22) Filed: May 14, 2007

(65) Prior Publication Data

US 2007/0286759 A1 Dec. 13, 2007

(30) Foreign Application Priority Data

Jun. 8, 2006 (CA) ..... 2550038

(51) Int. Cl.
*F03C 4/00* (2006.01)
*F04C 18/00* (2006.01)

(52) U.S. Cl. ..... 418/257; 418/265

(58) Field of Classification Search ..... 418/259–265, 418/256, 257
See application file for complete search history.

(56) References Cited

U.S. PATENT DOCUMENTS 949,431 A * 2/1910 Hokanson ..... 418/264
1,339,723 A * 5/1920 Smith ..... 418/265
1,393,698 A * 10/1921 Piatt ..... 418/265
2,819,677 A * 1/1958 Leath ..... 418/264
4,410,305 A * 10/1983 Shank et al. ..... 418/264
4,551,896 A 11/1985 Sakamaki et al.
5,002,473 A * 3/1991 Sakamaki et al. ..... 418/265
6,554,596 B1 4/2003 Patterson et al.
6,799,549 B1 10/2004 Patterson et al.
6,896,502 B1 5/2005 Patterson
6,945,218 B2 9/2005 Patterson
7,048,526 B2 5/2006 Patterson

FOREIGN PATENT DOCUMENTS

CA 202671 8/1920

* cited by examiner

*Primary Examiner*—Theresa Trieu
(74) *Attorney, Agent, or Firm*—Nixon Peabody LLP; Jeffrey L. Costellia

(57) ABSTRACT

A positive displacement pump having a centrally disposed rotor within a housing, the rotor having inwardly and outwardly moving vanes for movement of fluid through the pump. Races in end walls of the housing partly or entirely control movement of the vanes. A dam is movably positioned at the housing's fluid discharge port, the dam having upper and lower ends, the lower end of the dam extending into the housing and being positioned so as to be close to or in sliding contact with the surface of the rotor. This pump construction is extremely versatile in its construction and applications.

12 Claims, 7 Drawing Sheets

FLOATING DAM POSITIVE DISPLACEMENT PUMP

FIELD OF THE INVENTION

The present invention relates to a novel construction of positive displacement pump for fluids, and more particularly to a rotary piston pump.

BACKGROUND OF THE INVENTION

Rotary pistons of the type having an encased, eccentrically positioned rotor with radially extending vanes which move in and out of the rotor, depending upon their position on the rotational cycle of the rotor, are used for example as pumps or turbines. One such device is described in U.S. Pat. No. 6,554,596 of Albert and David Patterson issued Apr. 29, 2003, in which the vane movement, in and out of the rotor, is achieved by cam surfaces within the casing which act on both inner and outer edges of the vanes.

In my co-pending U.S. patent application Ser. No. 10/680,236 entitled "Rotary Pistons", the outward movement of the vanes of such a pump is achieved by upward extensions of shoulders at the sides of each vane, which upward extensions contain pins which are seated in races continuously extending in portions of the interior wall of the casing and positioned so that as the pins move about the races, they control the inward and outward movement of the vanes.

In my U.S. Pat. No. 6,896,502, issued May 24, 2005, an eccentrically positioned rotor is described and illustrated, provided with three planar vanes arranged in chord-like fashion in the rotor. The vanes' outward movement is accomplished by way of centrifugal force while inward movement of the vanes is caused by the cam action of the chamber walls bearing on outer edges of the vanes.

In my co-pending U.S. patent application Ser. No. 10/845,073, a positive displacement rotary piston pump is described and illustrated in which a pair of planar vanes are moveable in a slot diametrically extending through the rotor, the inward movement of the vanes being governed by cam action of the inner surface of the pump housing, and the outer movement being governed by centrifugal force and/or biasing.

It is an object of the present invention to provide an alternative constructions of positive displacement pump which will be adaptable to a wide range of different sizes and which will be adaptable to a wide variety of fluid and pressure conditions.

SUMMARY OF THE INVENTION

In accordance with the present invention a positive displacement pump is provided, the pump comprising a shaft to rotate about a longitudinal axis, a rotor centrally secured to the shaft, the rotor having a body with a cylindrical surface extending between spaced ends, and a rotor disk secured at each end of the rotor and secured at a centre of the rotor disk to the shaft.

A housing is provided defining an internal cavity within which are the rotor, the rotor disks and a portion of the shaft. The cavity is defined by end walls of the housing and a cylindrical housing side wall extending between the end walls. The rotor and rotor disks are centrally positioned with respect to the housing side wall. Fluid inlet and fluid discharge ports are provided at spaced locations in the housing side wall. There are provided two or more equally spaced, radially oriented slots in the rotor, which extend longitudinally across the rotor and its cylindrical surface. There are also provided two or more similar planar vanes, each having internal and external edges extending between sides. Each vane is slidably seated in a different one of the slots, each vane being moveable radially in its corresponding slot between an extended position with the external edge of the vane extending beyond the cylindrical surface of the rotor, adjacent the side wall of the housing, and a retracted position where the external edge of the vane does not extend beyond the cylindrical surface of the rotor. The vanes are spaced from adjacent vanes about the rotor such that there is always at least one vane positioned between the inlet and discharge ports, the sides of the vanes being slidably seated in corresponding slots in the rotor disks.

Pins extend outwardly from opposite sides at similar locations on the vanes. They pass through slots in the corresponding rotor disks. Ends of the pins are seated, for sliding movement, in races formed in interior surfaces of the housing end walls.

A discharge chamber is provided with which the discharge port directly communicates, the discharge chamber having opposed, spaced, upstream and downstream walls, and an exit for passage of fluid. A dam is moveably positioned adjacent the downstream wall of the discharge chamber. The dam has an upper and lower end, its lower end extending into the internal cavity of the housing and positioned so as to be near to or in sliding contact with the cylindrical surface of the rotor. The dam is configured to extend between the rotor disks, so as to direct fluid entering the discharge chamber towards the chamber's fluid exit. The races in the interior end walls of the housing and the pins on the vanes are configured so as to cause the vanes to move to retracted position as they approach the discharge port and dam, and to cause the vanes to move to extended position when the vanes have passed the discharge port and dam.

The pump of the present design is adaptable to a wide range of applications, including use in sewage systems or in coolant systems for large engines, or in high pressure applications such as bottling of carbonated beverages. The moveable dam arrangement permits pressure release within the pump as required, as will be described in more detail hereinafter.

BRIEF DESCRIPTION OF THE DRAWINGS

These and other advantages of the invention will become apparent upon reading the following detailed description and upon referring to the drawings in which.

Figure 1:
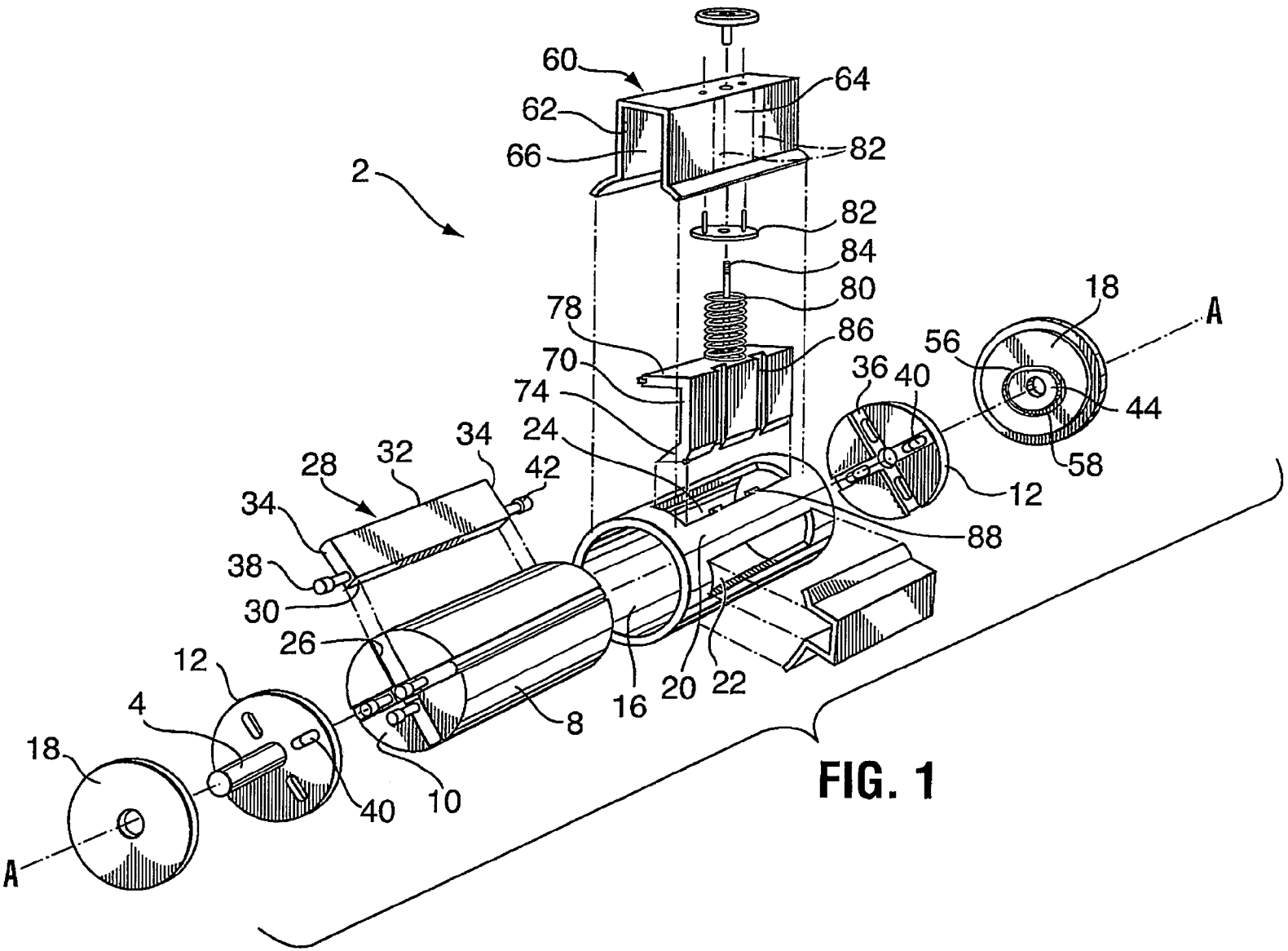
FIG. 1 is a perspective exploded view, partially broken away, of a positive displacement pump in accordance with the present invention.

The present invention will now be described by way of a non-limiting description of certain detailed embodiments.

DETAILED DESCRIPTION OF THE ILLUSTRATED EMBODIMENTS

In the following description, similar features in the drawings have been given identical reference numerals where appropriate. All dimensions described herein are intended solely to illustrate an embodiment. These dimensions are not intended to limit the scope of the invention that may depart from these dimensions.

Figure 2:
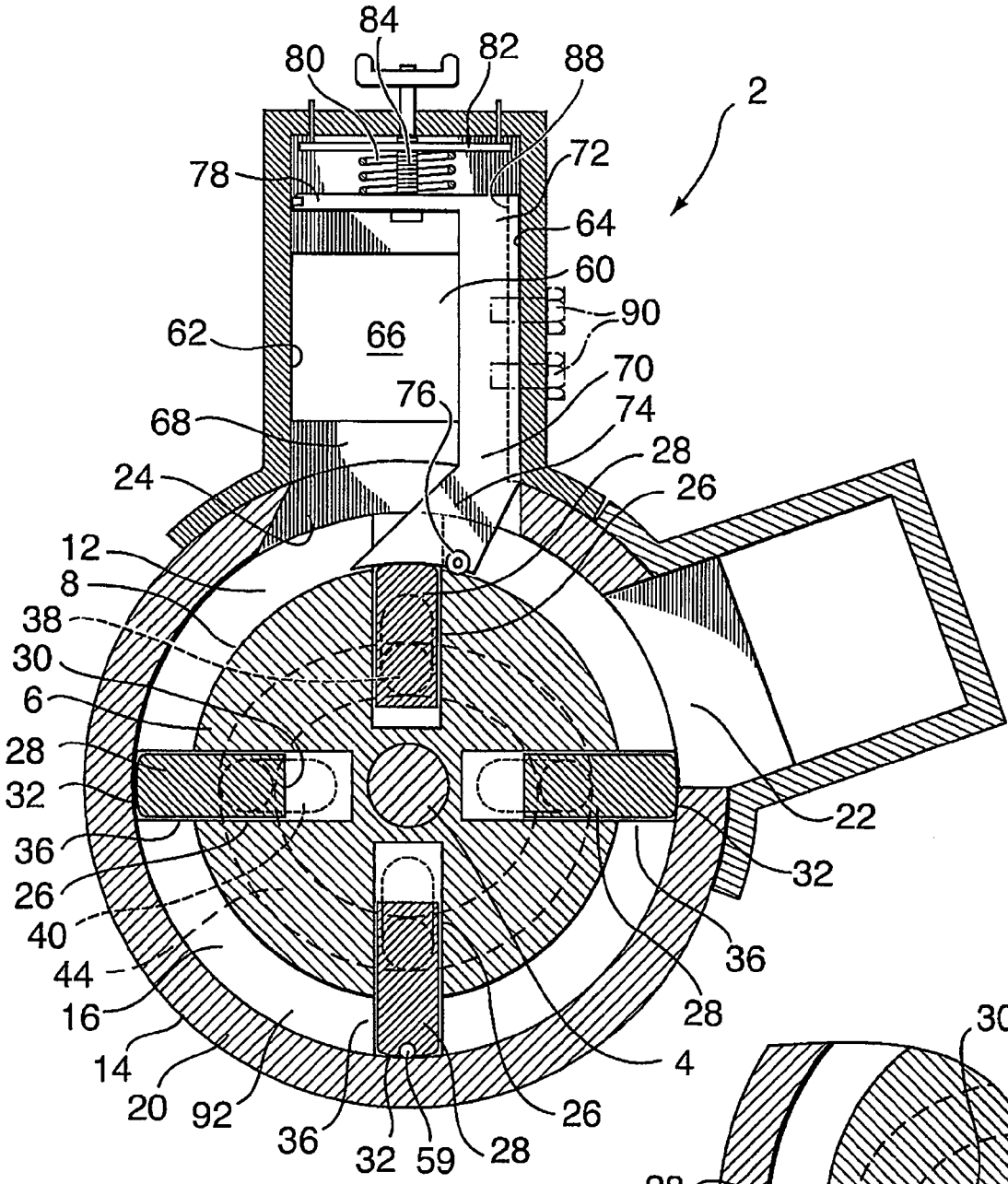
FIG. 2 is a side section view of the pump of FIG. 1, along line 2-2 of FIG. 1.

Turning to FIGS. 1 and 2, there is illustrated a positive displacement pump 2 according to the present invention, comprising a shaft 4 to rotate about a longitudinal axis A, as illustrated. A cylindrical rotor 6 (the rotor having a circular lateral cross-section) is centrally mounted on shaft 4, cylindrical surface 8 extending between spaced rotor ends 10. A rotor disk 12 is secured at each end 10 of the rotor, each disk 12 again centrally secured to shaft 4.

These components of pump 2 are situated within a housing 14 having an internal cavity 16. This cavity is defined by end walls 18 of the housing and a cylindrical housing side wall 20 extending between those ends. Rotor 6 and rotor disks 12 are centrally positioned with respect to side wall 20.

Spaced fluid inlet port 22 and fluid discharge port 24 are provided, as illustrated, in side wall 20.

Two or more, and in the illustrated embodiment four, equally spaced, radially oriented slots 26 are provided in the rotor, these slots extending longitudinally across the rotor and its cylindrical surface. An equal number (in the illustrated embodiment, four) of planar vanes 28, each having internal edges 30 and external edges 32 extending between sides 34 are seated in the slots, as illustrated. As can be seen in FIG. 2, each vane is slidably seated in its corresponding slot 26 for movement radially between an extended position with the external edge 32 extending beyond the cylindrical surface of the rotor and resting adjacent the side wall of the housing, and a retracted position wherein that external edge 32 does not extend beyond cylindrical surface 20 of the rotor. Vanes 28 are spaced from adjacent vanes about the rotor in a manner such that there is always at least one vane 28 positioned between fluid inlet port 22 and fluid discharge port 24. Sides 34 of vanes 28 are slidably seated in corresponding, aligned slots 36 in rotor disks 12. In this manner, slots 36 act as channels in rotor disks 12 to support the vanes 28, particularly when the vanes are in extended position.

Pins 38 extend outwardly from opposite sides 34 of vanes 28, at similar locations, as illustrated. These pins 38 pass through elongated slots 40 in the corresponding rotor disks, the ends or heads 42 of pins 38 being seated, for sliding movement, in a corresponding, endless groove 44 formed in the interior surface of the corresponding housing end wall 18. The configuration of race (endless groove) 44, as can be seen in FIGS. 8*c* and 9*b*, may be varied, depending upon the particular design and intended function of the pump. More particularly, as will be described in more detail subsequently, the configuration of race 44 reflected in FIG. 8*c* is intended for use on pumps where retraction of the vanes is the result of the race acting on the pins and where biasing or other means urges the vanes to extended position, whereas the configuration of races illustrated in FIG. 9*b* is intended for pumps where the race acting on the pins causes the vanes to move both to retracted and to extended positions.

Figure 8A:
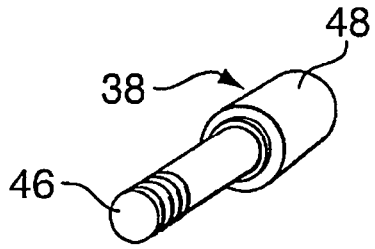
FIGS. 8*a* and 8*b* are respectively perspective, and side and side section views of a vane pin construction in accordance with the present invention.
Figure 8B:
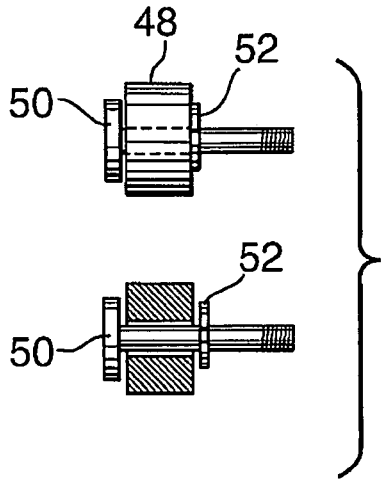
Figure 8C:
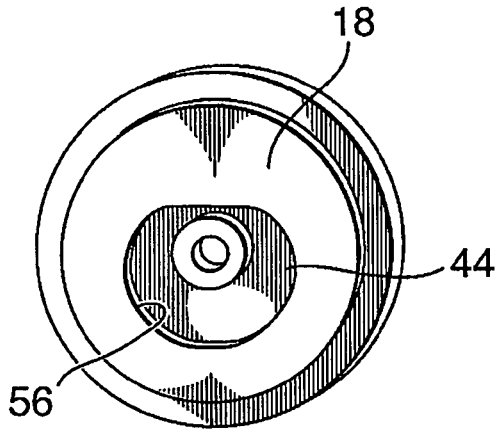
FIG. 8*c* is a perspective view of an end wall of the housing of the pump in accordance with the present invention, illustrating an endless groove in which the vane pin of FIGS. 8*a* and 8*b* may travel.

More detailed aspects of the construction and operation of the pins for these two race configurations are illustrated in FIGS. 8*a* and 8*b* (for the race configuration of FIG. 8*c*) and FIGS. 9*a* and 9*c* (for the race configuration of FIG. 9*b*). More particularly, as can be seen in FIG. 8*b*, a single-headed pin 38 is provided, threaded at end 46 to engage in a corresponding threaded hole in the side of a vane 28. At the other end of this pin 38 is a hardened steel sleeve bearing 48 held on pin 38 by means of a pin head 50 at the free end thereof and a horseshoe locking washer 52 seated in an appropriate groove in the body of pin 38 as illustrated.

Figure 9A:
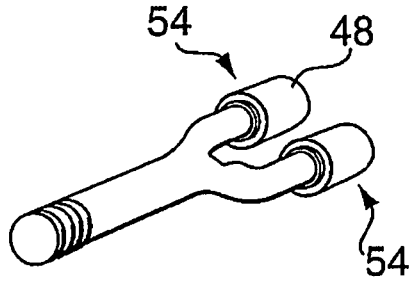
FIG. 9*a* is a perspective view of a double-headed vane pin in accordance with the present invention.
Figure 9B:
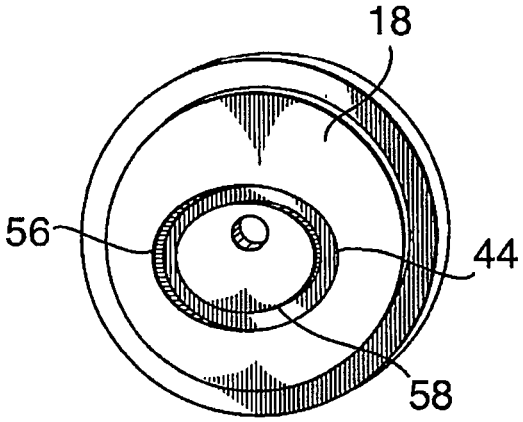
FIG. 9*b* is a perspective view of an end wall of the housing of the pump in accordance with the present invention, illustrating the race in which the vane pin of FIG. 9*a* may travel.
Figure 9C:
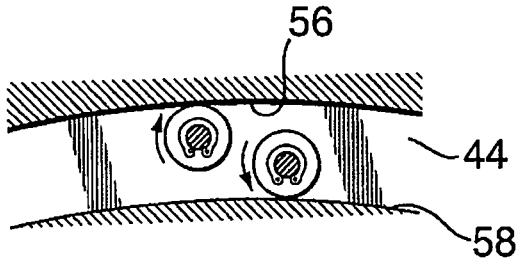
FIG. 9*c* is a schematic view of the vane pin of FIG. 8*a* illustrating its operation in the race of FIG. 9*b*.

In the double-headed pin 38 illustrated in FIG. 9*a*, the pin construction is similar except that it is provided with a pair of heads 54 with a pair of hardened steel sleeve bearings 48 one on each head 54. In this case, the bearings 48 rotate in opposite fashion, as illustrated in FIG. 9*c*, as the pin moves in the illustrated direction in the race of the illustrated configuration of FIG. 9*b*.

It will be understood that the cam action of the outer edge 56 of the races 44 of FIGS. 8*c* and 9*b*, acting/on bearings 48 of pins 38, will cause the corresponding vane 28 to move towards or stay at retracted position, and the inner edge 58 of the race 44 of the race configuration illustrated in FIG. 9*b* will act on bearings 48 and the corresponding pins to move vanes 28 from retracted to extended position. FIG. 9*b* illustrates the race configuration of the embodiment illustrated in FIGS. 1 and 2. As can be seen in FIG. 2, external edges 32 of vanes 28 may be provided with an optional pin bearing 59 along its length, acting to roll and seal with respect to the interior surface of housing side wall 20, during operation of the pump.

Figure 2A:
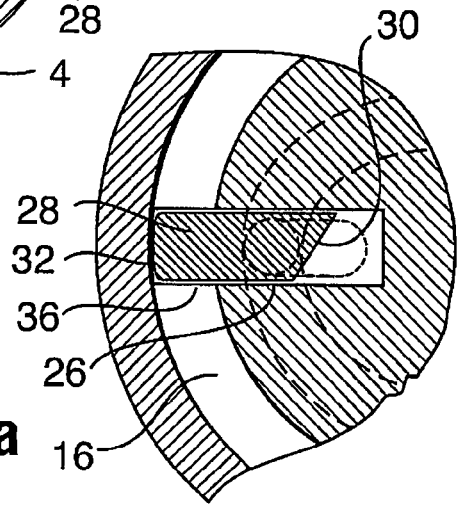
FIG. 2*a* is a side section detailed view of an alternative embodiment of vane, in a slot of the rotor disk of the pump of FIG. 1.

In FIG. 2*a* there is illustrated an alternative embodiment of vane 28 in accordance with the present invention, wherein internal edge 30 is angled or beveled, as illustrated, so that, when the vanes of this construction are in retracted position in their corresponding slots 26, there is a reduced potential for fluid-suspended sediment to collect and pack into slots 26, as might be the case with the "flat" internal edges 30 illustrated in the embodiment of FIG. 2.

Associated and communicating with discharge port 24 of housing 14 is a discharge chamber 60. This chamber has opposed spaced "upstream" (with respect to the direction of fluid in housing cavity 16) wall 62 and "downstream" wall 64 as illustrated. An exit 66 for passage of fluid from the discharge chamber 60 is provided either in upstream wall 62 or in one or both end walls 68 of chamber 60.

A dam 70 is positioned adjacent the downstream wall 64, within chamber 60, dam 70 having an upper end 72 and lower end 74 as illustrated. Lower end 74 extends into the internal cavity 16 of housing 14 and is preferably forwardly angled, in an upstream direction. This angling of the lower portion 74 of dam 70 reduces jamming of vanes 28 in their slots 26 as a result of solids from the fluid building up in those slots, and provides a "scraper" action in this regard. Dam 70 is positioned so as to have its lower end 74 proximal to the cylindrical surface 8 of rotor 6. It extends between rotor disks 12 and acts to direct fluid, entering the discharge chamber 60, towards the chamber's fluid exit 66.

Races 44 in the interior end walls 18 of housing 14, and the pins 38 on vanes 28 are configured so as to cause vanes 28 to move to retracted position as the vanes approach the discharge port 24 and dam 70, and to cause the vanes to move to extended position when they have passed the discharge port and dam 70.

As illustrated in FIG. 2, a pin bearing roller seal 76 is provided along the lower end 74 of dam 70 to reduce passage of fluid between the dam 70 and the rotor 6 and rotor vanes during operation of the pump.

As seen in FIG. 2, the upper end 72 of dam 70 is provided with a diaphragm 78 sitting in an upper portion of discharge chamber 60 as illustrated. A spring 80 and a spring plate 82 threaded to an adjustment rod 84 provide an adjustable bias against upward movement of diaphragm 78 within discharge chamber 60. Preferably a wedge-shaped keyway 86 on the rear wall of dam 70 slidably and mateably receives a key arrangement 88, provided in the downstream side of discharge port 24 and on the downstream wall of discharge chamber 60 as illustrated (FIG. 1) to control relative upward and downward movement of dam 70 within discharge chamber 60. Bolts 90 may be optionally provided between downstream wall 64 of chamber 60 and dam 70, to lock dam 70 and its lower end 74 in position on wall 64, where that relative movement is not required.

Diaphragm 78 is intended to lift dam 70, within chamber 60, so that its lower end 74 becomes lifted above rotor surface 8, when there is a pressure build up in internal cavity 16 within pump housing 14, and in particular in one of the chambers 92 formed in that internal cavity 16 between adjacent pairs of vanes 28, corresponding portions of the housing side wall 20, rotor disks 12 and housing end walls 18, to allow some of that pressure to escape to the other side of dam 70, towards inlet port 22. This pressure release mechanism, permitted when dam 70 is allowed to "float" with diaphragm 78, greatly enhances the operation of this construction of pump in certain situations such as in engine cooling systems, where RPM speed of the pump is regulated by mechanical attachment to the engine drive system. In such systems, a sudden increase in RPM could overpressurize the cooling system. This problem is addressed by the pressure "bypass" function of the dam 70/diaphragm 78 arrangement. As well, this "floating" dam arrangement protects the pump itself from damage if a sudden blockage downstream in the discharge flow occurs. Moreover, this arrangement also allows the operator to adjust the pressure at which dam 70 will be lifted for discharge of pressure, through adjustment of the positioning of spring plate 82 on adjustment rod 84.

Figure 3:
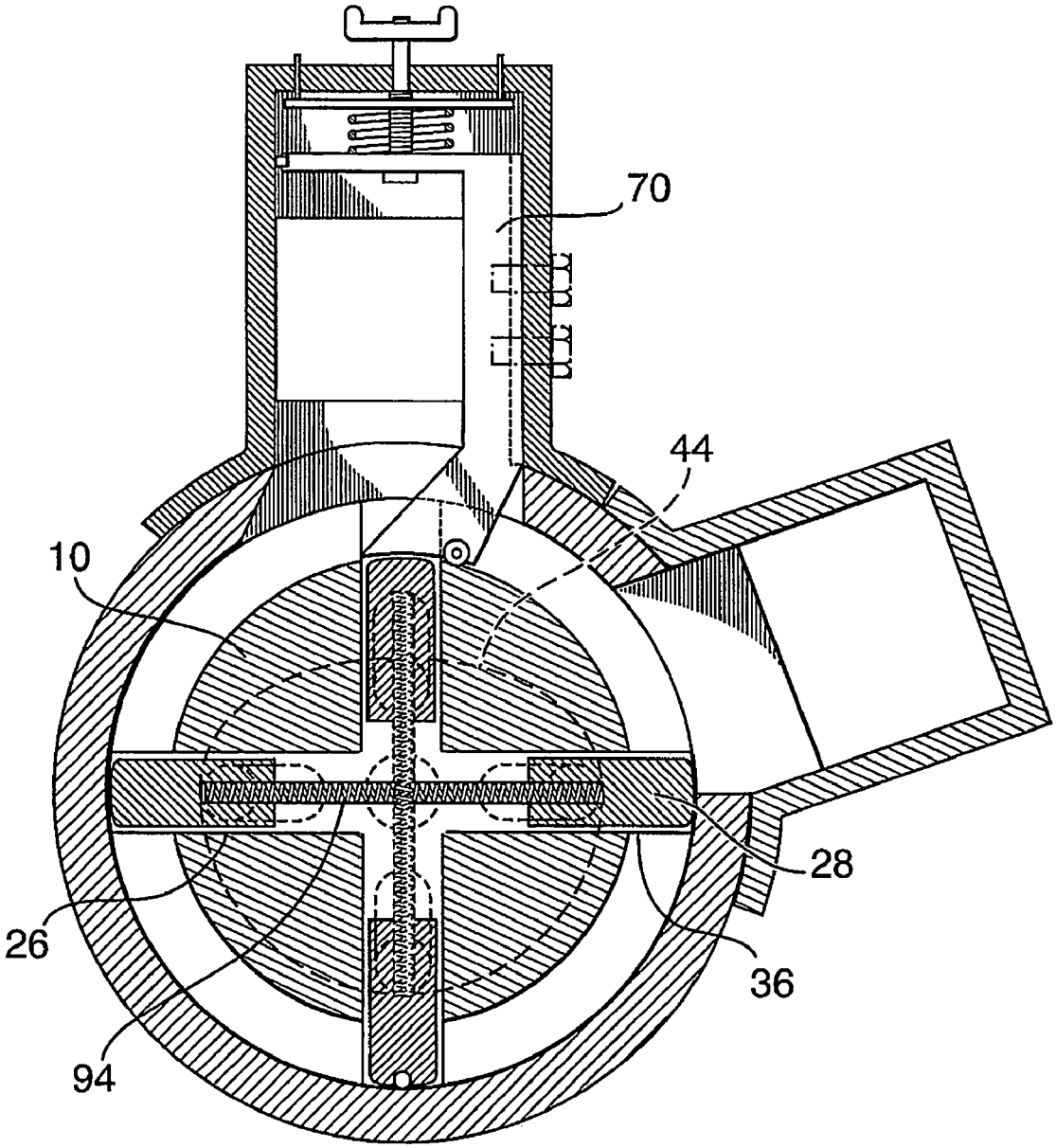
FIG. 3 is a side section view, similar to that of FIG. 2, but of an alternative embodiment of positive displacement pump in accordance with the present invention.

In the alternative embodiment of pump 2 illustrated in FIG. 3, while most of the components are similar to those of FIGS. 1 and 2, opposite slots 26 have portions extending through rotor 10 to communicate with each other, and spring actuators 94 extend between opposing vanes through these communicating portions of the slots. As well, because the bias from spring actuators 94 ensures that, at all times, vanes 28 are biased outwardly from rotor 6, the configuration of race 44 only to move vanes 28 to retracted position, as illustrated in FIG. 8*c*, is appropriate. Of note, the portion of race 44 nearest discharge port 24 is relatively flat and not rounded. This feature prevents vanes 28 from skipping when the pump 2 and its rotor 6 are operating at higher RPM's.

The spring actuators 94 and the corresponding communicating portions of one pair of opposed slots 26 are offset from the spring actuators and corresponding communicating portions of the other pair of opposed slots 26.

Figure 4:
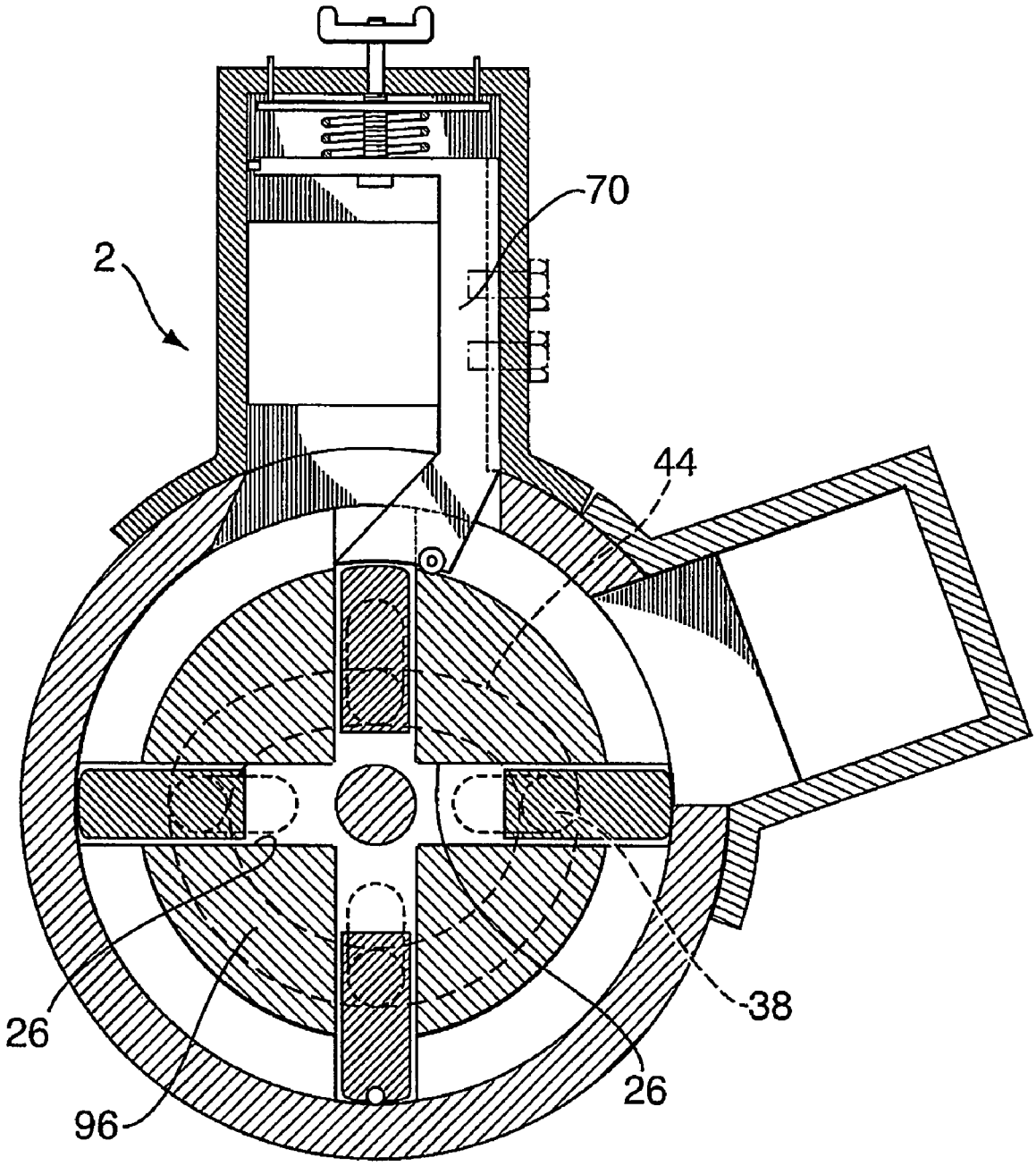
FIG. 4 is a similar section view to that of FIGS. 2 and 3, of yet a further embodiment of positive displacement pump in accordance with the present invention.

In the embodiment of the present invention illustrated in FIG. 4, again most of the components of pump 2 are similar to those of the embodiment FIGS. 1 and 2. However, in this embodiment, races 44 are configured as illustrated in FIG. 9*b* so that the race walls, acting on pins 38, provide the inward and outward motion of vanes 28 within slots. As well, opposed slots 26 extend through rotor 10 to their corresponding, opposed slots, the quadrants 96 of rotor 10 being supported in position by rotor disks 12. This embodiment of pump reduces the chance of fluid being trapped in a single vane's slot 26, which fluid might otherwise restrict the corresponding vane 28 from moving into the retracted position. Also, construction of the rotor is facilitated, since problems of machining a rotor with "square bottomed" slots 26 are avoided.

Figure 5:
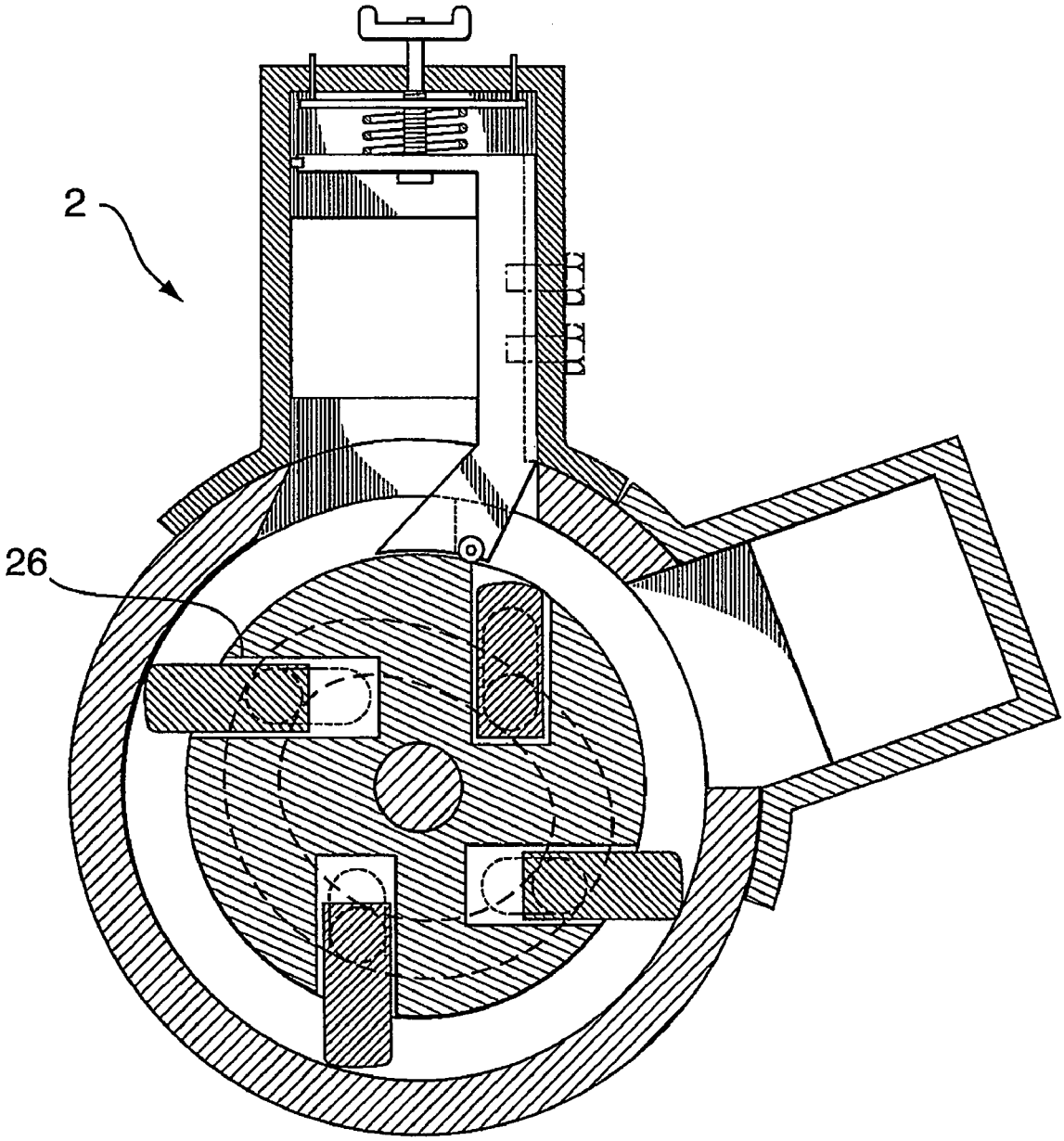
FIG. 5 is a further side section view of yet a further embodiment of positive displacement pump in accordance with the present invention.

Turning to FIG. 5, the slots 26 within which vanes 28 move are offset, but parallel to a corresponding axial plane through the rotor 10, as illustrated. Otherwise the construction and operation of this embodiment of pump 2 is similar to that of the embodiment of FIGS. 1 and 2. This embodiment of pump is advantageous in that it permits the vanes 28 and slots 26 to extend more deeply into the core of rotor 10 while still leaving, for strength, more rotor body around the central shaft 4. As well, the angle of vanes 28, as they approach dam 70, enhances the sweeping action of the angled, lower end 74 of dam 70, reducing the likelihood that solids will be trapped at vanes 28 or the edges 30 and 32 of the vanes 28.

Figure 6:
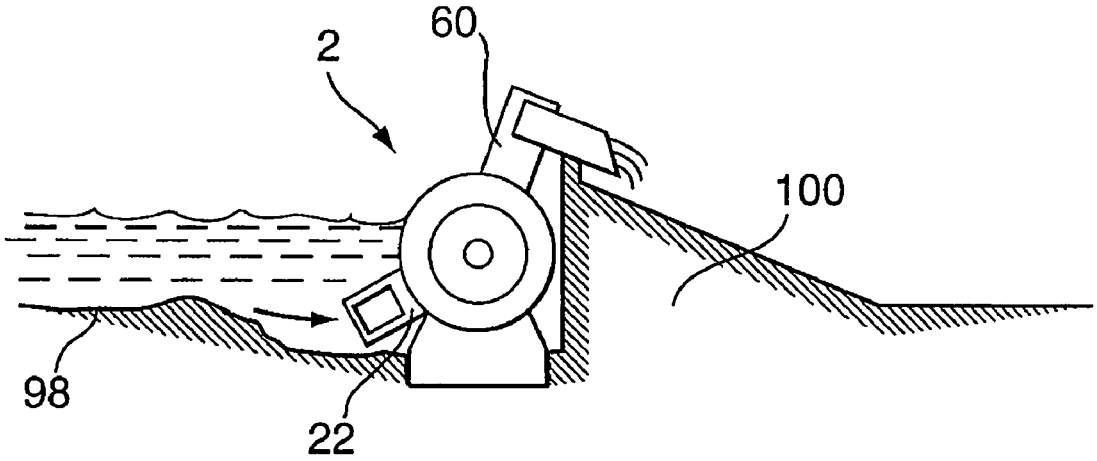
FIG. 6 is a schematic view of a positive displacement pump in accordance with the present invention in a flood plain/dyke environment, illustrating an application of the positive displacement pump in accordance with the present invention.

The pump construction according to the present invention permits a pump of considerable lateral width to be constructed. Consequently, applications such as quickly removing water on a flood plain 98, as illustrated in FIG. 6, to the other side of a dyke 100 is envisaged. In this embodiment of pump 2, the inlet port 22 and discharge port 24 may be more widely separated as illustrated.

Figure 7:
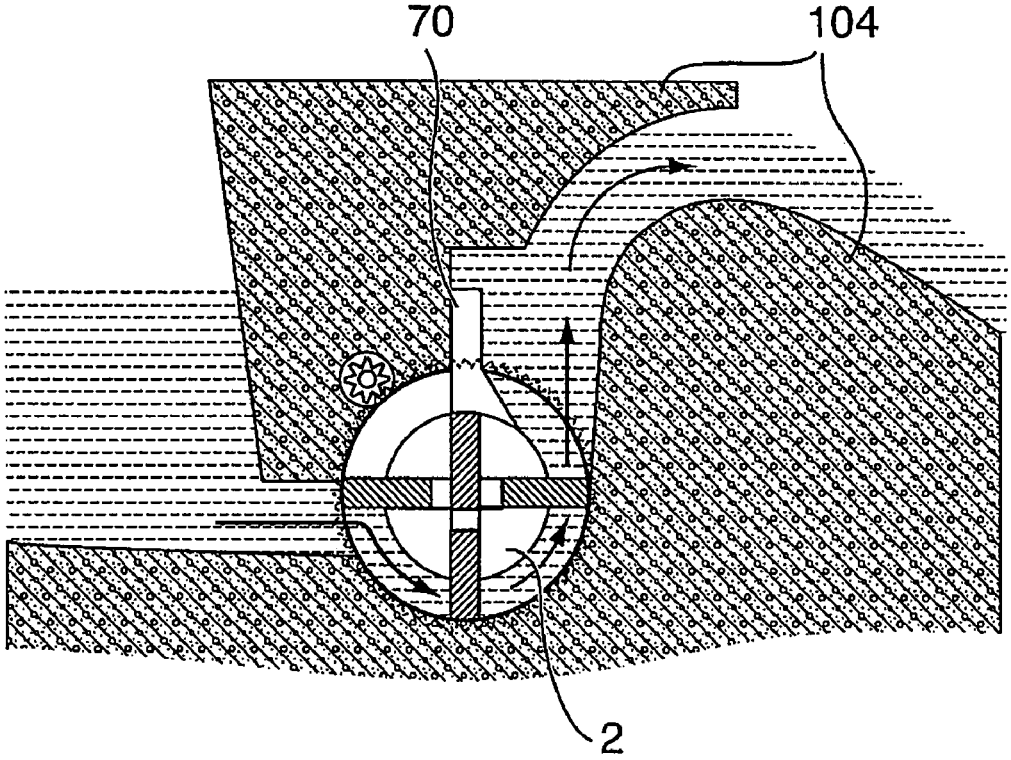
FIG. 7 is a schematic side section view of yet a further application of positive displacement pump in accordance with the present invention.

A schematic side view of yet a further alternative construction of pump 2 in accordance with the present invention is illustrated in FIG. 7, where pump 2 is actually embedded in a poured concrete dyke arrangement 104. This embodiment represents a more permanent pump installation for major water works. A low speed rotation is achieved by a reduction gearing arrangement schematically illustrated at reference numeral 106. Given the low leak-down rate of this embodiment of pump 2, this pump can stop water flow without the use of auxiliary valves or gates when the pump is not operating.

It should be understood that the pump construction of the present invention can be used not only as a pump, but also as a meter or a motor. It is envisaged that it can be either motor or hand driven, depending on the desired application.

Thus, although the present invention has been described by way of a detailed description in which various embodiments and aspects of the invention have been described, it will be seen by one skilled in the art that the full scope of this invention is not limited to the examples presented herein. The invention has a scope which is commensurate with the claims of this patent specification including any elements or aspects which would be seen to be equivalent to those set out in the accompanying claims.

What I claim as my invention:

1. A positive displacement pump comprising:

(a) a shaft to rotate about a longitudinal axis;

(b) a rotor centrally secured to the shaft, the rotor having a body with a cylindrical surface extending between spaced ends;

(c) a rotor disk secured at each end of the rotor and secured at a centre of the rotor disk to the shaft;

(d) a housing defining an internal cavity within which are the rotor, the rotor disks and a portion of the shaft, the cavity defined by end walls of the housing and a cylindrical housing side wall extending between the end walls, the rotor and rotor disks centrally positioned with respect to the housing side wall;

(e) fluid inlet and fluid discharge ports at spaced locations in the housing side wall;

(f) two or more equally spaced, radially oriented slots in the rotor, longitudinally extending across the rotor and its cylindrical surface;

(g) two or more similar planar vanes, each having internal and external edges extending between sides, each vane slidably seated in a different one of said slots, each vane moveable radially in its corresponding slot between an extended position with the external edge of the vane extending beyond the cylindrical surface of the rotor, adjacent the side wall of the housing, and a retracted position wherein the external edge of the vane does not extend beyond the cylindrical surface of the rotor, the vanes being spaced from adjacent vanes about the rotor such that there is always at least one vane positioned between the inlet and discharge ports, the sides of the vanes slidably seated in corresponding slots in the rotor disks;

(h) pins extending outwardly from opposite sides at similar locations on the vanes, the pins passing through slots in the corresponding rotor disks and ends of the pins being seated, for sliding movement, in races formed in interior surfaces of the housing end walls;

(i) a discharge chamber with which the discharge port directly communicates, the discharge chamber having opposed, spaced, upstream and downstream walls, and an exit for passage of fluid;

(j) a dam moveably positioned adjacent the downstream wall of the discharge chamber, the dam having an upper and lower end, its lower end extending into the internal cavity of the housing and positioned so as to be close to or in sliding contact with the cylindrical surface of the rotor, the dam configured to extend between the rotor disks, so as to direct fluid entering the discharge chamber towards the chamber's fluid exit;

the races in the interior end walls of the housing and the pins on the vanes being configured so as to cause the vanes to move to retracted position as they approach the discharge port and dam, and means being provided to cause the vanes to move to extended position when the vanes have passed the discharge port and dam.

2. A pump according to claim 1, wherein said means to cause the vanes to move to extended position being the races acting on the pins.

3. A pump according to claim 1, wherein biasing means are associated with the vanes to cause the vanes to move to extended position.

4. A pump according to claim 3, wherein four vanes and four slots are provided in the rotor, diametrically opposed vanes being provided with biasing means urging those vanes outwardly towards extended position.

5. A pump according to claim 1, wherein the lower portion of the dam is angled forwardly in an upstream direction to reduce jamming of the vanes in their corresponding slots as a result of solids in the fluid.

6. A pump according to claim 5, wherein a pin bearing roller seal is provided across the lower surface of the dam to reduce passage of fluid between the dam and the rotor and rotor vanes.

7. A pump according to claim 1, wherein an upper end of the dam is provided with a diaphragm sitting within the discharge chamber, the diaphragm being biased against relative upward motion of the dam within the chamber.

8. A pump according to claim 7, wherein a surface of the dam confronting a downstream wall of the discharge port housing is provided with a key adapted to slidably move up and down within a keyway in the downstream wall of the discharge port housing.

9. A pump according to claim 8 further provided with bolts for securing the dam to the downstream wall against relative movement within the discharge chamber.

10. A pump according to claim 1, wherein pin bearings are provided along the external edges of the vanes.

11. A pump according to claim 1, provided with four slots in the rotor and four vanes.

12. A positive displacement pump comprising:

(a) a shaft to rotate about a longitudinal axis;

(b) a rotor centrally secured to the shaft, the rotor having a body with a cylindrical surface extending between spaced ends;

(c) a rotor disk secured at each end of the rotor and secured at a centre of the rotor disk to the shaft;

(d) a housing defining an internal cavity within which are the rotor, the rotor disks and a portion of the shaft, the cavity defined by end walls of the housing and a cylindrical housing side wall extending between the end walls, the rotor and rotor disks centrally positioned with respect to the housing side wall;

(e) four equally spaced slots in the rotor cylindrical surface, the slots extending parallel to and being offset from diagonal planes through the rotor;

(f) four or more similar vanes, each having internal and external edges extending between sides, each vane slidably seated in a different one of said slots, each vane moveable in its corresponding slot between an extended position with the external edge of the vane adjacent the side wall of the housing, and a retracted position wherein the external edge of the vane does not extend beyond the cylindrical surface of the rotor, the vanes being spaced from adjacent vanes about the rotor such that there is always at least one vane positioned between the inlet and discharge ports, the sides of the vanes slidably seated in corresponding slots in the rotor disks;

(g) pins extending outwardly from opposite sides at similar locations on the vanes, the pins passing through slots in the corresponding rotor disks and ends of the pins being seated, for sliding movement, in endless grooves formed in interior surfaces of the housing end walls;

(h) a discharge chamber with which the discharge port directly communicates, the discharge chamber having opposed, spaced, upstream and downstream walls, and an exit for passage of fluid;

(i) a dam moveably positioned adjacent the downstream wall of the discharge chamber, the dam having an upper and lower end, its lower end extending into the internal cavity of the housing and positioned so as to be in sliding contact with the cylindrical surface of the rotor, the dam configured to extend between the rotor disks, so as to direct fluid entering the discharge chamber towards the chamber's fluid exit;

the endless grooves in the interior end walls of the housing and the pins on the vanes being configured so as to cause the vanes to move to retracted position as they approach the discharge port and dam, and to cause the vanes to move to extended position when the vanes have passed the discharge port and dam.

* * * * *